US010563889B2

(12) United States Patent
Wu et al.

(10) Patent No.: US 10,563,889 B2
(45) Date of Patent: Feb. 18, 2020

(54) CONTINUOUS-FLOW WATER HEATING ASSEMBLY AND PRODUCTION METHOD

(71) Applicant: Nestec S. A., Vevey (CH)

(72) Inventors: Fenghua Wu, Shanghai (CN); Ruguo Hu, Shanghai (CN)

(73) Assignee: Societe des Produits Nestle S.A., Vevey (CH)

( * ) Notice: Subject to any disclaimer, the term of this patent is extended or adjusted under 35 U.S.C. 154(b) by 0 days.

(21) Appl. No.: 15/328,325

(22) PCT Filed: Aug. 20, 2014

(86) PCT No.: PCT/CN2014/084801
§ 371 (c)(1),
(2) Date: Jan. 23, 2017

(87) PCT Pub. No.: WO2016/026097
PCT Pub. Date: Feb. 25, 2016

(65) Prior Publication Data
US 2017/0211843 A1 Jul. 27, 2017

(51) Int. Cl.
*F24H 1/10* (2006.01)

(52) U.S. Cl.
CPC ..... *F24H 1/102* (2013.01)

(58) Field of Classification Search
CPC ..... F24J 1/102; F23M 5/08; F24H 9/2028; F24H 1/102; F16L 53/008
USPC ..... 392/465, 468, 472, 471; 122/235.11, 122/235.17, 235.29, 4 A
See application file for complete search history.

(56) References Cited

U.S. PATENT DOCUMENTS 1,382,156 A * 6/1921 Abogado ..... F24H 1/106 392/315
1,689,521 A * 10/1928 Dominguez ..... F24H 1/106 392/318
2,775,683 A * 12/1956 Kleist ..... F25B 43/00 222/146.3
4,651,917 A 3/1987 Gould et al.
4,975,559 A 12/1990 Frisch
5,098,047 A * 3/1992 Plumley ..... F16L 3/2235 248/68.1
5,558,069 A 9/1996 Stay
6,327,718 B1 * 12/2001 Ono ..... E03D 9/08 4/420.2
6,928,237 B2 * 8/2005 Matsunaga ..... B60H 1/2221 392/480

(Continued)

FOREIGN PATENT DOCUMENTS

CN 2537923 Y 2/2003
CN 2538240 Y 3/2003

(Continued)

OTHER PUBLICATIONS

International Search Report, dated Jun. 11, 2015, in PCT/CN2014/084801, filed Aug. 20, 2014.

(Continued)

*Primary Examiner* — Jimmy Chou
(74) *Attorney, Agent, or Firm* — K&L Gates LLP

(57) ABSTRACT

A water heating assembly is disclosed the includes a core heating element and an outer tube in which the core heating element is arranged. Also disclosed are methods for producing and using the water heating assembly.

10 Claims, 7 Drawing Sheets

(56) References Cited

U.S. PATENT DOCUMENTS

| | | | | |
|---|---|---|---|---|
| 6,968,125 | B1 * | 11/2005 | Garber | F24H 1/102 392/492 |
| 7,386,225 | B2 * | 6/2008 | Lin | F24F 6/18 392/386 |
| 7,591,302 | B1 * | 9/2009 | Lenehan | H01L 23/34 165/104.33 |
| 7,920,779 | B2 * | 4/2011 | Shirai | E03D 9/08 392/465 |
| 8,985,531 | B2 * | 3/2015 | Wood | B22F 3/1055 174/93 |
| 9,648,983 | B2 * | 5/2017 | Hofer | A47J 31/542 |
| 9,784,471 | B2 * | 10/2017 | Lee | F24H 1/162 |
| 2006/0027103 | A1 | 2/2006 | Boussemart et al. | |
| 2010/0046934 | A1 * | 2/2010 | Johnson | F24H 1/121 392/480 |
| 2010/0325861 | A1 * | 12/2010 | Gardner | F16L 9/147 29/428 |
| 2011/0036544 | A1 * | 2/2011 | Shirai | E03D 9/08 165/95 |
| 2012/0315024 | A1 * | 12/2012 | Obst | B60H 1/2221 392/465 |
| 2013/0108249 | A1 * | 5/2013 | Krause | B67D 3/0022 392/465 |
| 2014/0166238 | A1 | 6/2014 | Sandu | |
| 2014/0287374 | A1 * | 9/2014 | Lee | H05B 3/40 432/219 |

FOREIGN PATENT DOCUMENTS

| | | | |
|---|---|---|---|
| CN | 2551953 | Y | 5/2003 |
| CN | 1702419 | A | 11/2005 |
| CN | 1890510 | A | 1/2007 |
| CN | 201522210 | U | 7/2010 |
| CN | 102679792 | A | 9/2012 |
| EP | 0119606 | A2 | 9/1984 |
| EP | 0154878 | A1 | 9/1985 |
| EP | 1400762 | A1 | 3/2004 |
| WO | 2007014811 | A1 | 2/2007 |
| WO | 2008110847 | A2 | 9/2008 |
| WO | 2010106349 | A2 | 9/2010 |
| WO | 2010133409 | A1 | 11/2010 |

OTHER PUBLICATIONS

Written Opinion of the International Searching Authority, dated Jun. 11, 2015, in PCT/CN2014/084801, filed Aug. 20, 2014.

EP14900335; Nestec S.A.; Extended European Search Report dated Mar. 23, 2018, filed Aug. 20, 2014.

CN Application No. 201480081054.3; Nestec S. A., filed Aug. 20, 2014; Office Action dated Aug. 28, 2018.

* cited by examiner

CONTINUOUS-FLOW WATER HEATING ASSEMBLY AND PRODUCTION METHOD

CROSS-REFERENCE TO RELATED APPLICATIONS/INCORPORATION BY REFERENCE STATEMENT

This application is a US national stage application filed under 35 USC § 371 of International Application No. PCT/CN2014/084801, filed Aug. 20, 2014. The entire contents of the above-referenced patent applications are hereby expressly incorporated herein by reference.

TECHNICAL FIELD

The presently disclosed and/or claimed inventive concept(s) relates to a water heating assembly, especially a continuous-flow water heating assembly and a method for producing a water heating assembly.

BACKGROUND

Today, there exist mainly three types of water heating systems for table-top coffee makers, tea makers, beverage vending machine and the like. A first type is a boiler. A heater such as an electrical resistant coil is immersed inside a water tank and in direct contact with the water. Hot water is prepared and stored continuously. A second type is a thermoblock system. A heating element and a water tube are cast inside an aluminum block, which is kept at a high temperature as long as the machine is maintained in the use mode. Water flowing through the water tube is heated by the stored heat of the aluminum block. A third type is a heating belt. A heating unit surrounds a water tank and heats the wall of the water tank, thus heating the water inside.

All of the above-described heating systems cannot provide hot water on-demand, since they cannot heat water without delay. A certain preparation time is necessary. These systems are relatively bulky and heavy.

Therefore, a fourth type of water heating system is a continuous flow heater using a tube heating water as water circulates continuously inside the tube. In particular, WO 2008/110847 A2 shows a continuous-flow water heating apparatus, which comprises a heating element, which is arranged within a water tube. The water tube and the heating element form a gap through which the water flows. This continuous flow heating system has disadvantages though, since a very long water tube and therefore also a very long heating element is necessary for heating the water and since the time of exposure to the heat of the heating element is very short due to the geometry of the water tube. This results in a high weight and a high volume of the resulting water heater.

U.S. Pat. No. 4,975,559 relates to a device for heating and aerating water in a coffee machine. The water circuit has water circulation channels and air retaining pockets disposed at intervals along the water circulation channels above the normal water levels of the channels. The air retaining pockets provide turbulence in circulating water and cause the air retained in the pockets to be dissolved in the water.

US2006027103A1 relates to a device for heating liquid in a beverage machine. The device comprises a tube heater with a water inlet, a water outlet and an insert inside the tube comprising helical grooves. The water is forced through a small gap in helical manner. One problem is that water temperature is difficult to control and can be over-heated. This requires a complex set of resistors which are electrically linked. Furthermore, the inside insert provides an elevated pressure loss in the fluid circuit that needs to be overcome.

BRIEF DESCRIPTION OF THE DRAWINGS

An exemplary embodiment of the presently disclosed and/or claimed inventive concept(s) is now further explained with respect to the drawings in which

DETAILED DESCRIPTION

Figure 1:
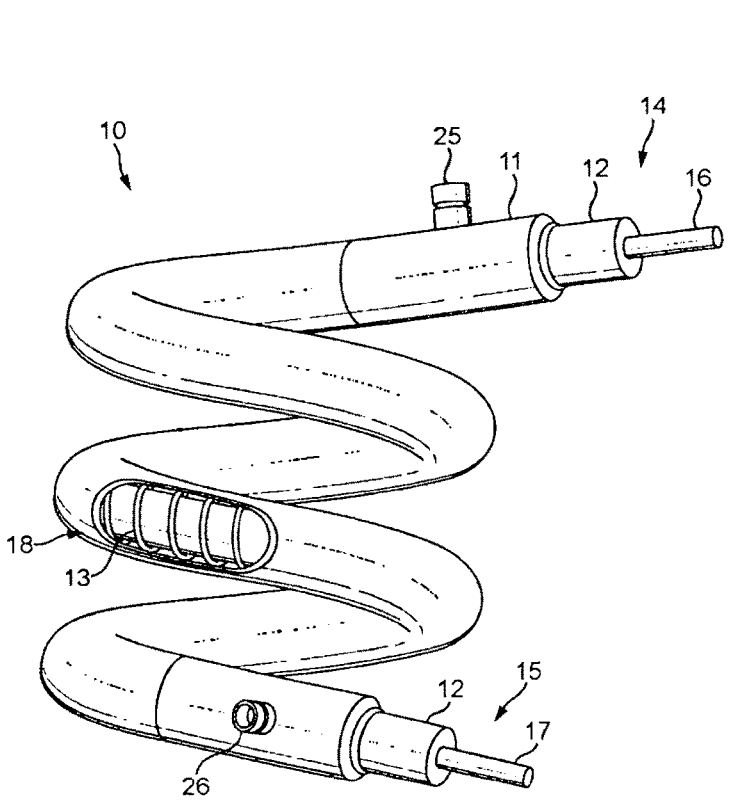
FIG. 1 shows a first embodiment of the inventive water heating assembly.

Accordingly, one non-limiting object of the presently disclosed and/or claimed inventive concept(s) is to provide a continuous-flow water heating assembly, which has a low volume and/or foot print, a low weight, improved heat transfer efficiency and is easy and cost effective to assemble and produce.

The object is solved by the subject-matter of the independent claims. The dependent claims contain further developments.

An inventive water heating assembly comprises a core heating element and a tube. The heating element is arranged within the tube forming gap for flow path between the heating element and an inner wall of the tube and is adapted to heat water within the gap. The water heating assembly comprises a spacer element (herein also referred to as flow affecting means or turbulence generation means) arranged within the gap. The tube thus surrounds a flow path which is at least partially formed by the gap including the spacer elements. The spacer element disturbs the flow of water through the gap and therefore increases the exposure time of the water to the heat emitted by the heating element. This results in a longer flow path per length unit of tube of the water heating assembly low weight and low volume water heating assembly. According to the presently disclosed and/or claimed inventive concept(s), therefore no water tank or aluminum block, which are heated, are necessary. Therefore it is not necessary to preheat the system before the hot water is ready for use. Furthermore, the heating element can be advantageously shortened while providing the same heating efficiency.

In certain non-limiting embodiments, the gap extends along the whole flow path surrounded by the tube. Therefore, the heating element is an elongated tubular element of smaller cross section than the tube that at least extends along the length of the whole tube. The effect of the presently disclosed and/or claimed inventive concept(s) can thus be maximized.

Advantageously, the spacer element is adapted to hold the tube and the heating element at a defined distance. Since the spacer element therefore contributes to the structural integrity of the water heating assembly, additional element holding the tube and heating element can be omitted. This results in a further reduced weight and volume of the resulting water heating assembly.

In certain non-limiting embodiments, the outer tube is formed in a non-rectilinear shape. In a particular (but non-limiting) mode, the outer tube is formed into a three-dimensional shape such as a helical form. In particular, this enables to produce a very compact heating assembly with high heating efficiency that can be easily fitted into small beverage machines such as table top beverage makers. In another mode, the outer tube is formed into a two-dimensional shape such as a M- or two dimensional spiral form.

In certain non-limiting embodiments, the core heating element is preferentially formed of the same general shape as the shape of the tube but with reduced cross-section enabling the formation of the small gap of tubular section in-between.

In one aspect, the spacer element is a discrete element which is independent from the core heating element and outer tube. The advantage lies in that the heating assembly can be configured to the correct size and assembled more easily and in a more cost effective manner. By easily interchanging the spacer element but keeping the same other elements of the heating assembly, it is possible to change radially the heating and flow characteristics of the assembly thereby offering important design and production flexibility.

Further advantageously, the spacer element is a coil spring arranged between and in contact with the heating element and an inner wall of the tube. Windings of the spring form a helical water path. The use of a spring further stabilizes the water heating assembly, while at the same time significantly increasing the length of the path the water has to flow within the water heating assembly. Thereby, the exposure time of the water to the heat is significantly increased, which allows for an increase of the heat transfer efficiency per unit of length of the heating assembly or tube, and for a very light and low-volume construction of the water heating assembly. Furthermore, the pitch of the coil spring can be varied depending on the flow conditions and heating characteristics desired.

The spacer element may comprise at least one groove (such as, but not limited to, a helical groove) along an inner wall of the tube and/or along an outer wall of the heating element. The groove forms a water path (such as, but not limited to, a helical water path). In comparison to using a spring for forming the water path, this solution requires one part less. The production cost thereby can be further reduced.

The spacer element can be a helical wire for instance having a cross section which round or, advantageously, square or rectangular. A square or rectangular cross section provides larger surfaces of contact with the internal surface of the tube and heating element, thereby preventing damage or deformation of the tube or heating element by pressure exerted by the wire and may also facilitate the assembling such as the insertion of the wire between the tube and heating element.

The spacer element may also comprise a plurality of longitudinally spaced apart spacers arranged between an inner wall of the tube and an outer wall of the heating element. By use of the indentations, it is also possible to use one part less than when using a spring. This allows further reduction in production cost. The spacers are each adapted to generate a non-linear tortuous water flow path within the gap and/or turbulence in the water flow within the gap. By using individual spacers, which do not have to be placed at pre-specified locations within the gap, a very easy construction is possible.

Advantageously, the tube comprises a water inlet adapter to receive water to be heated and a water outlet adapter to discharge the heated water. The heating element is adapted to heat the water passing the heating element within the gap. A continuous-flow water heating is thereby possible.

Advantageously, the water heating assembly furthermore comprises a control unit, a pump and at least one temperature sensor, such as (but not limited to) a negative temperature coefficient resistor. The pump is adapted to pump water through the gap. The at least one temperature sensor is adapted to monitor at least a temperature at a water discharge end of the tube. The control unit is adapted to control the pumping of the pump based upon the temperature sensed by the at least one temperature sensor. A very efficient water heating to an exactly specifiable temperature is thereby possible.

Advantageously, the temperature sensor is arranged in a water outlet of the heating assembly. A very simple construction is thereby possible.

Alternatively, the temperature sensor is arranged within the tube and in contact with the heating element at a water discharge end of the heating element. The temperature sensor is adapted to sense a temperature of surrounding water, if the gap is filled with water and to sense a temperature of the heating element if the gap is not filled with water. The sensor can therefore be used for determining, if the gap is filled with water.

Advantageously, the control unit is adapted to determine if the gap is filled with water by activating the heating element, monitoring the temperature sensed by the temperature sensor and determining that the gap is filled with water, if a heat build-up is slower than a threshold value and that the gap is not filled with water if the heat build-up is faster than the threshold value. The control unit is adapted to deactivate the heating element, if the control unit has determined that the gap is not filled with water. An accidental overheating of the system can thereby be prevented. Additionally, energy savings are thereby possible.

Advantageously, the tube can be a stainless steel tube. The tube can also be of a different material such as copper or aluminium. The tube is imperviously welded or soldered to the heating element at a water loading end of the tube and at a water discharging end of the tube. A very long lifetime of the water heating assembly can thereby be achieved.

Alternatively, the tube can be a silicone rubber tube, which is imperviously connected to the heating element at a water loading end of the tube and at a water discharging end of the tube by clamps. In this case, this is the core heating element itself that provides the permanent shape to the water heating assembly. A very low production cost can thereby be achieved.

An inventive method for producing a water heating assembly using a spring or spacers as spacer element comprises producing the tube, the heating element and the spacer element, inserting the heating element and the spacer element into the tube and imperviously connecting a water loading end of the tube, a water discharging end of the tube to the heating element, and optionally, connecting the water outlet and water inlet to the tube and optionally connecting the water sensor to the water outlet or tube. A very simple and low-cost production is thereby made possible.

An inventive method for producing a water heating assembly using a groove as spacer element comprises producing the tube and the heating element, including producing the at least one groove by any of the following operation: casting, milling, pressing or combination thereof, inserting the heating element into the tube, imperviously connecting a water loading end of the tube and a water discharging end of the tube to the heating element, and optionally, connecting the water outlet and water inlet to the tube and optionally connecting the water sensor to the water outlet or tube. Also by this production method, a very low-cost production is possible.

An inventive method for producing a water heating assembly, which uses indentations of the tube as spacer element comprises producing the tube and the heating element, inserting the heating element into the tube, creating the indentations by pressing the tube against the heating element, imperviously connecting the water loading end of the tube and a water discharging end of the tube to the heating element, and optionally, connecting the water outlet and water inlet to the tube and optionally connecting the water sensor to the water outlet or tube. For creating permanent indentations protruding inside the tube, the tube is, in certain non-limiting embodiments, made of a plastically deformable material such as metal (aluminium, copper, steel, etc.). Also by this method a low-cost production of the water heating assembly is possible.

The presently disclosed and/or claimed inventive concept(s) is also directed to a method for heating water using the water heating assembly according to the presently disclosed and/or claimed inventive concept(s).

First, the construction and function of different embodiments of the inventive water heating assembly is shown in FIGS. 1-12. In a second step, the function of several embodiments of the inventive production method is explained along FIGS. 13-15. Similar entities and reference numbers in different Figures have been partially omitted.

In FIG. 1, a first embodiment of the inventive water heating assembly 10 is shown. The water heating assembly 10 comprises a tube 11 which surrounds a heating element 12. The tube 11 and the heating element 12 are not in close contact but delimit a gap 19. The gap is of general tubular cross-section. Within the gap 19, is located a spacer element 13 that occupies part of the gap and that holds the tube 11 and the heating element 12 in relative position to each other. In certain non-limiting embodiments, the spacer element 13 can be preferentially a coil spring. The tube 11 comprises a water inlet 26 on a water loading end 15 and a water outlet 25 on a water discharging end 14 of the water heating assembly 10. Moreover, the heating element 12 comprises electrical connectors 16, 17 which, in certain non-limiting embodiments, extend from the opposite ends of the tube 11.

The spacer element 13 is arranged between the tube 11 and the heating element 12 so that a helical (flow) path between the windings of the spring 13 is formed. The pitch of the coil spring can be determined so that the shorter it is, the longer the flow path. Water passing from the water inlet 26 through the tube 11 to the water outlet 25 has to follow this helical path formed by the windings of the spring 13, increasing the length of the path the water has to flow and thereby increasing the time, the heating element 12 is in contact with the water.

The opening in the tube 11 as displayed in the region 18 is not part of the actual water heating assembly 10, but is only depicted here, so that the spring 13 can be seen. The inventive water heating assembly does not have such an opening. The tube 11 is imperviously sealed around the ends of the water heating assembly. A water flow can only occur through the water inlet 26 and water outlet 25.

Figure 2:
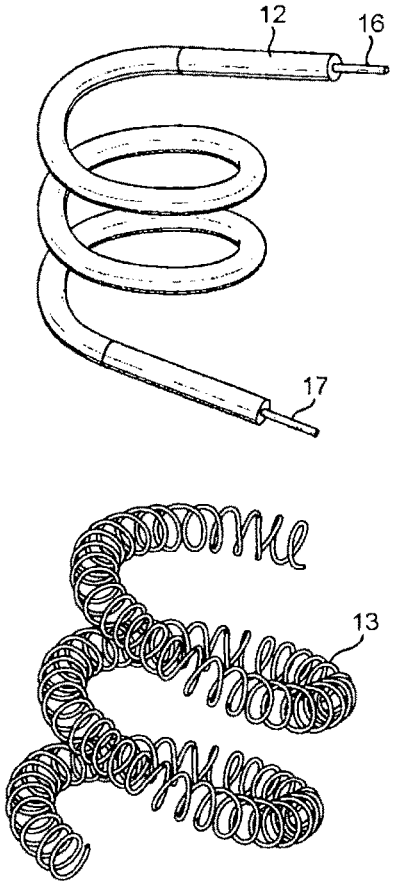
FIG. 2 shows several parts of said first embodiment of the inventive water heating assembly.

In FIG. 2, some of the components of the water heating assembly 10 of FIG. 1 are shown individually. In the top-most image, the heating element 12 is shown. The inner heating element 12 comprises electrical connectors 16, 17. In the middle image, the coil spring 13 is shown individually. In the lower image, the outer tube 11 is shown individually.

Figure 3:
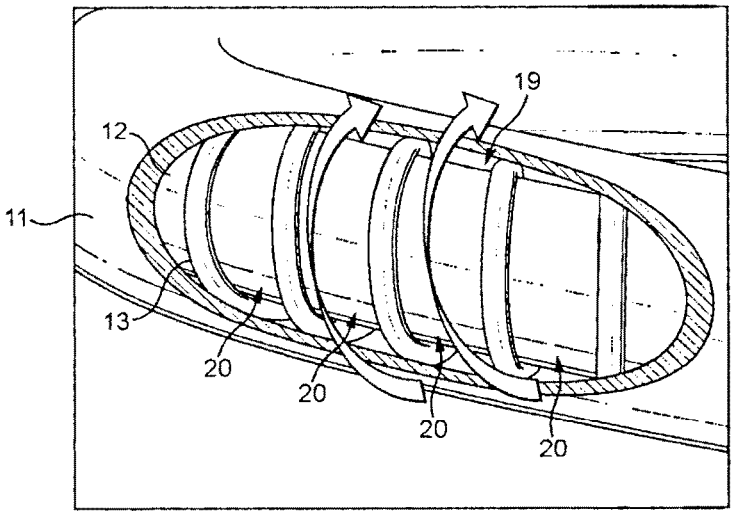
FIG. 3 shows a detail said first embodiment of the inventive water heating assembly.

In FIG. 3 a detail of the water heating assembly 10 shown in FIG. 1 is shown. The detail corresponds to the area labeled as 18 in FIG. 1. Here, the helical paths 20, which are formed by the windings of the spring 13 within the gap between the heating element 12 and the tube 11 can easily be seen. Instead of flowing directly from the water inlet 26 to the water outlet 25 through the gap, the water has to follow along these helical paths 20 and therefore spirally around the heating element 12 numerous times.

Figure 4:
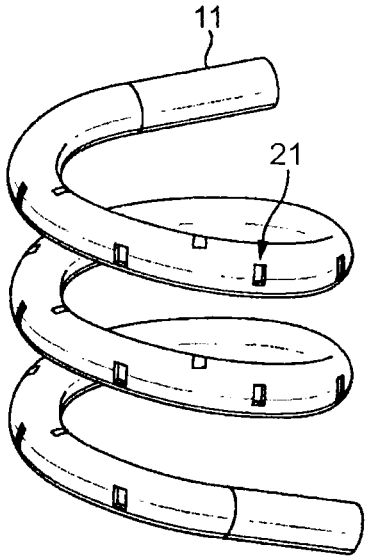
FIG. 4 shows a tube of a second embodiment of the inventive water heating assembly.

In FIG. 4, a further embodiment of the inventive water heating assembly is shown. Here only the tube 11 is depicted. The tube 11 comprises indentations 21 as a spacer element. The indentations stretch into the inside of the tube 11. In certain non-limiting embodiments, the indentions 21 bridge the gap 19 and are in contact with the heating element 12. Water flowing past the indentations 21 within the gap 19 has to divert around the indentations creating a longer path for the water. The tube can be made of a material that is plastically deformable to enable to retain the permanent helical shape of the tube and the production of the indentations. The material for the tube can be steel, aluminium, cooper and the like.

Figure 5:
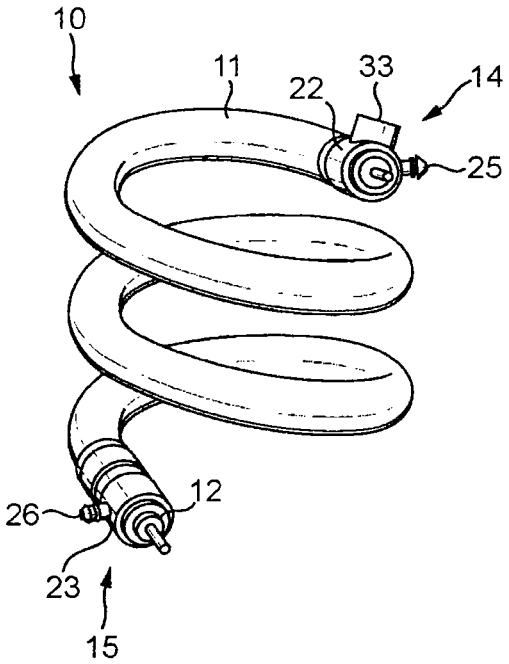
FIG. 5 shows a variant of the inventive water heating assembly.

In FIG. 5, a further embodiment of the inventive water heating assembly 10 is shown. In this example, the tube 11 can be a silicone rubber or metal tube, which is imperviously connected to the heating element 12 at the water loading end 15 and the water discharging end 14 of the water heating assembly 10. This impervious connection is formed by clamps 22, 23 which, in certain non-limiting embodiments, also include the water inlet 26 and the water outlet 25. Moreover the clamp 22 on the water discharge end 14 of the water heating assembly 10 comprises a temperature sensor 33. The temperature sensor can be a thermistor, a negative temperature coefficient resistor, a positive temperature coefficient resistor, or any other type of temperature sensor. Regarding the position and the function of the temperature sensor, it is referred to the later discussion regarding FIG. 8 and FIG. 10.

Figure 6:
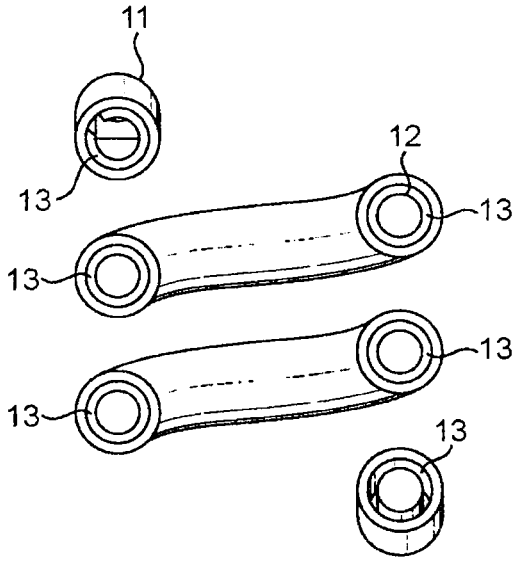
FIG. 6 shows another variant of the inventive water heating assembly in a sectional view.

In FIG. 6, a further embodiment of the inventive water heating assembly 10 is shown. Here, a sectional view is shown. The sectional view allows for an excellent view of the individual windings of the spring 13 which is arranged within the gap 19 between the tube 11 and the heating element 12.

Figure 7:
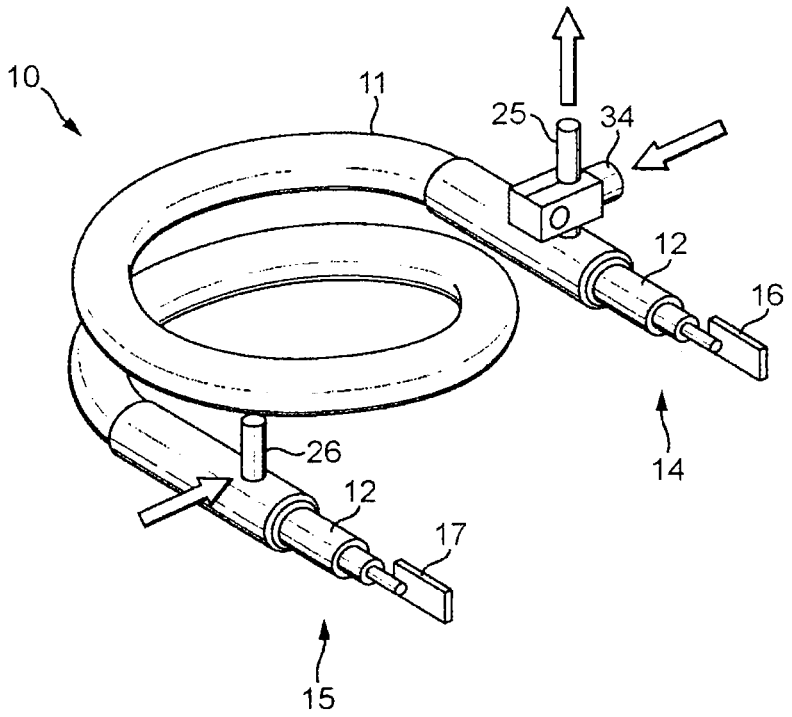
FIG. 7 shows a third embodiment of the inventive water heating assembly.

In FIG. 7, a further embodiment of the inventive water heating assembly 10 is depicted. Here, the tube 11 is a stainless steel tube, which is imperviously soldered or welded to the heating element 12 at a water loading end 15 of the water heating assembly 10 and at a water discharging end 14 of the water heating assembly 10. In FIG. 7, also the water inlet 26 and the water outlet 25 can easily be seen. Moreover, a temperature sensor 34 is connected to the water outlet 25. Regarding the function of the temperature sensor 34, it is referred to deliberations regarding FIG. 8 and FIG. 9.

Figure 8:
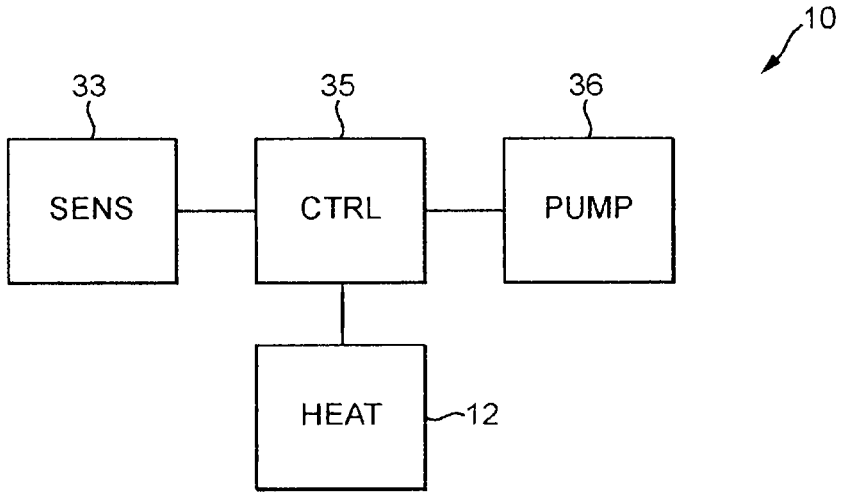
FIG. 8 shows the inventive water heating assembly in a block diagram.

In FIG. 8, a further embodiment of the inventive water heating assembly 10 is shown in a block diagram. The water heating assembly 10 comprises a sensor 33, which corresponds to the sensor 33 of FIG. 5, but can also correspond to the sensor 34 of FIG. 7, a control unit 35, a pump 36 and a heating element 12. The temperature sensor 33, the pump 36 and the heating element 12 are each connected to the control unit 35. The control unit 35 receives a temperature measured by the temperature sensor 33 and controls the function of the pump 36 and the function of the heating element 12.

The pump 36 pumps water through the water heating assembly 10. While the water is pumped through the water heating assembly 10, the heating unit 12 heats the water. By varying the amount of pumping and heating, the control unit 35 can vary the temperature and amount of the water heated by the water heating assembly 10. Especially by forming a control loop between the pump 36, the heating element 12 and the temperature sensor 33, a very accurate control of the amount and temperature of heated water is possible.

Figure 9:
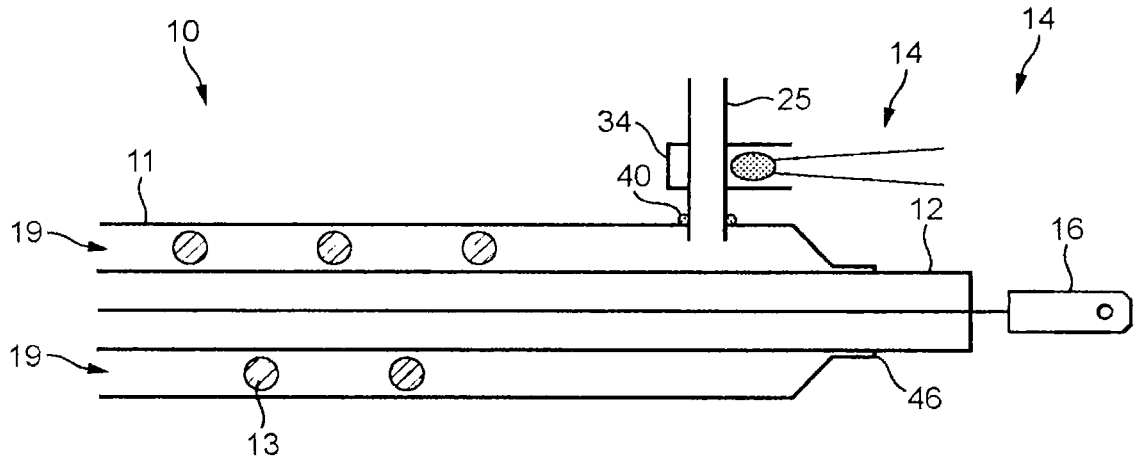
FIG. 9 shows a detail of the inventive water heating assembly.

In FIG. 9, a detail of a further embodiment of the inventive water heating assembly 10 is shown. The water heating assembly 10 comprises a tube 11 and a heating element 12 which form a gap. Within the gap, a spring 13 is located. The part of the water heating assembly 10 depicted here is the water discharge end 14. Clearly visible here is the water outlet 25, which comprises a temperature sensor 34. The temperature sensor 34 has a connection wire 44. This configuration with the temperature sensor 34 provided to the water outlet 25 can be applied to any of the previous embodiments of FIGS. 1 to 8, as well as to the next embodiments of FIGS. 11 and 12.

Moreover, the water outlet 25 is connected to the tube 11 by use of a weld 40. Moreover, the tube 11 is connected to the heating element 12 by use of a weld 46. In the example shown here, the temperature sensor 34 can only measure the temperature of water flowing through the water outlet 25. This is sufficient for regulating the output water temperature, but cannot be used for a safety shutoff of the water heating assembly.

Figure 10:
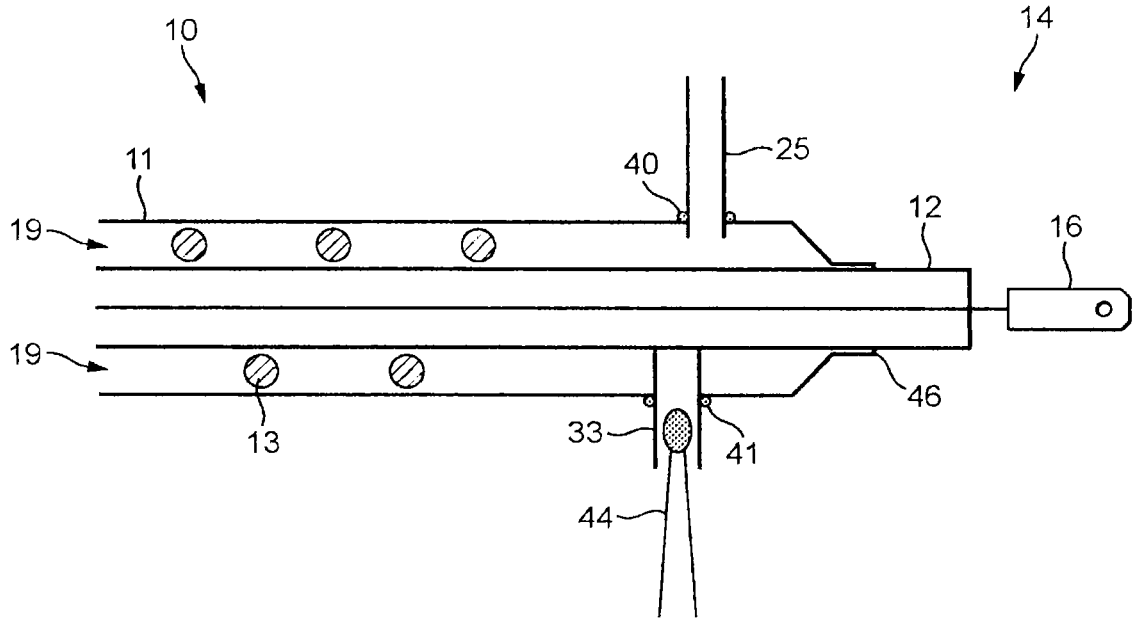
FIG. 10 shows a detail according to a variant of the inventive water heating assembly.

In FIG. 10, an alternative embodiment is shown. The water heating assembly 10 depicted here corresponds to the water heating assembly of FIG. 9, with the exception that the temperature sensor is located within the tube 11 and optionally is in contact with the heating element 12. The temperature sensor 33 is connected to the tube 11 by use of a weld 41. By connecting the temperature sensor 34 to the tube 11 and placing it in contact with the heating element 12 or close to the heating element 12, it is possible to not only measure the temperature of the water surrounding the temperature sensor 33, but also to measure the temperature of the heating element 12. While water surrounds the temperature sensor 33, the temperature registered by the temperature sensor 33 corresponds to the temperature of the water. In case of no water surrounding the temperature sensor 33 though, the temperature sensor 33 registers the temperature of the heating element 12. Since the heating element 12 is usually far hotter than the surrounding water if active, the temperature sensor 33 therefore detects different temperatures depending upon it being surrounded by water or not. This feature can be used for detecting, whether or not the water heating assembly is filled with water, and for automatically switching off the heating element 12 in case that no water is present within the water heating assembly 10. This configuration with the temperature sensor 34 provided within the tube can be applied to any of the previous embodiments of FIGS. 1 to 8, as well as to the next embodiments of FIGS. 11 and 12.

Figure 11:
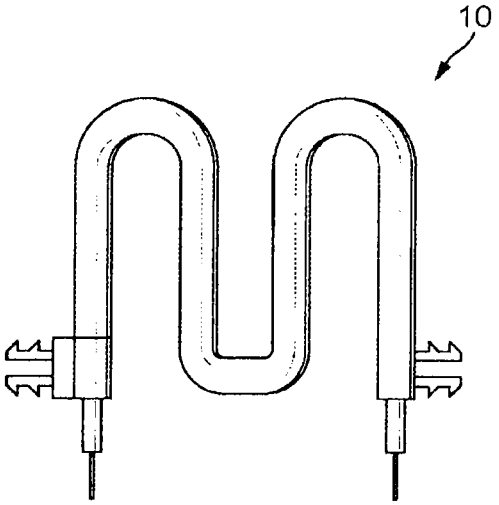
FIG. 11 shows an fourth embodiment of the inventive water heating assembly.

In FIG. 11, a further embodiment of the water heating assembly 10 is shown. Here, the water heating assembly 10 performs an M-shape resulting in a high water heating capacity within a low volume and footprint.

Figure 12:
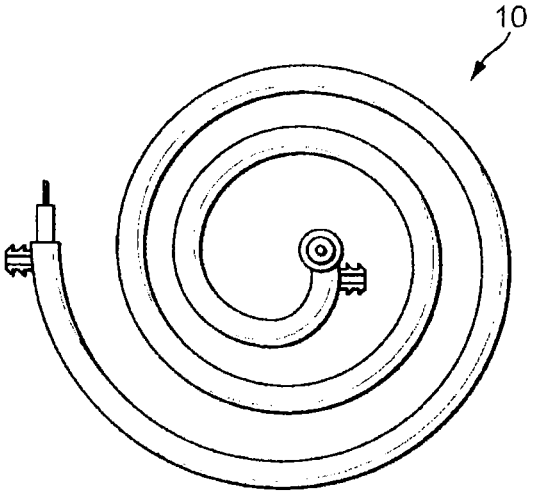
FIG. 12 shows a fifth embodiment of the inventive water heating assembly.

An alternative embodiment of the water heating assembly 10 is shown in FIG. 12. Here, the water heating assembly 10 performs a 'two-dimensional' spiral shape, resulting in an even more increased water heating capacity with a very low volume and footprint.

Figure 13:
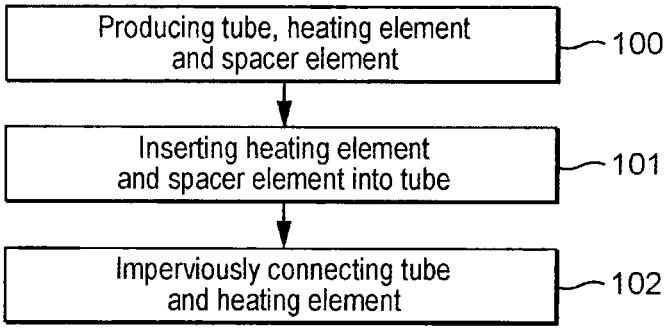
FIG. 13 shows a first embodiment of the inventive production method in a flow-diagram.

In FIG. 13, a first embodiment of the inventive production method is shown in a flow diagram. The production method described here corresponds to the use of a spring or individual spacers as spacer element 13 within the gap 19 between the tube 11 and the heating element 12. In a first step 100, the tube 11, the heating element 12 and the spacer element 13 are produced separately. In certain non-limiting embodiments, the heating element and spacer element (such as a coil spring) are produced in a rectilinear fashion and, the elements including the tube are cut to a desired length. In a second step 101, the heating element 12 and the spacer element 13 are inserted into the tube 11. In a third step 102, the heating element 12 and the tube 11 are connected imperviously at both ends of the water heating assembly 10. In an optional final step, the entire water heating assembly 10 can be shaped into a desired permanent shape, such as helical, as shown in FIG. 11 and FIG. 12 by bending. Finally, a water inlet 26 and water outlet 25, as represented in FIG. 1, are connected, such as by welding, in the tube at the appropriate locations. A temperature sensor can be connected in the water outlet such as in the mode of FIG. 9. Alternatively, the temperature sensor is connected, such as by welding, to the tube itself as in the mode of FIG. 10.

Figure 14:
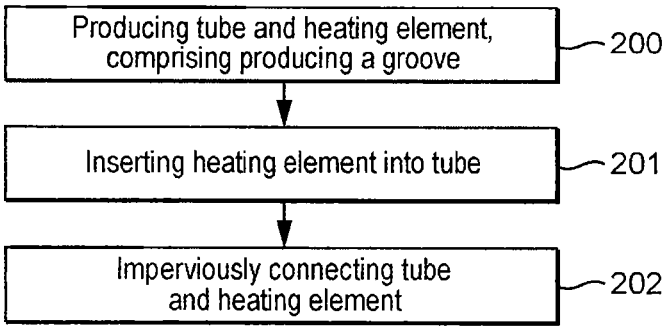
FIG. 14 shows a second embodiment of the inventive production method in a flow-diagram.

In FIG. 14, a second embodiment of the inventive production method is shown. The method shown here corresponds to using a groove of the outer wall of the heating element 12 or of the inner wall of the tube 11 as spacer element. In a first step 200, the tube 11 and the heating element 12 are produced. The step includes producing at least one groove as part of the outer wall of the heating element 11 and/or as part of the inner wall of the tube 11. In certain non-limiting embodiments, the heating element and spacer element (such as a coil spring) are produced in a rectilinear fashion and, the elements including the tube are cut to a desired length. In a second step 201, the heating element 12 is inserted into the tube 11. In a third step 202, the heating element 12 and the tube 11 are connected imperviously at both ends of the water heating assembly 10. Also here, by bending the entire water heating assembly 10, a desired permanent shape can be achieved. Finally, a water inlet 26 and water outlet 25, as represented in FIG. 1, are connected, such as by welding, in the tube at the appropriate locations. The connection may include the drilling of an outlet hole and an inlet hole in the wall of the tube; then welding the water outlet and water inlet to the respective holes. A temperature sensor can be connected in the water outlet such as in the mode of FIG. 9. Alternatively, the temperature sensor is connected, such as by welding, to the tube itself as in the mode of FIG. 10.

Figure 15:
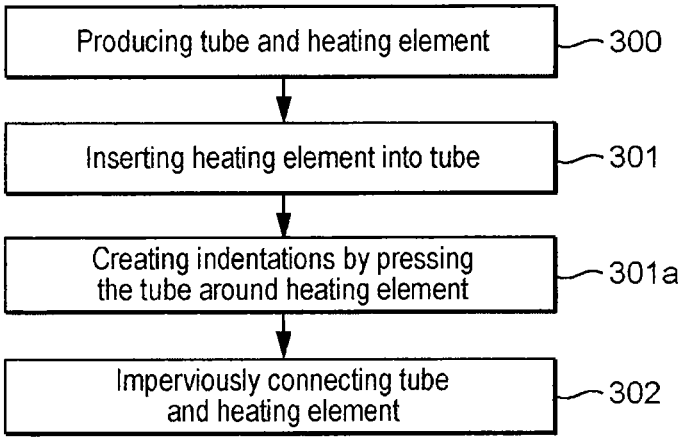
FIG. 15 shows a third embodiment of the inventive production method in a flow-diagram.

In FIG. 15 a further embodiment of the inventive production method is shown. The method shown here corresponds to using indentations 21 as spacer element. In a first step 300, the tube 11 and the heating element 12 are produced. In certain non-limiting embodiments, the heating element and spacer element (such as a coil spring) are produced in a rectilinear fashion and, the elements including the tube are cut to a desired length. In a second step 301, the heating element 12 is inserted into the tube 11. In a third step 301*a*, indentations 21 are created by pressing the tube 11 around the heating element 12. These indentations 21 are pressed into the gap 19 between the tube 11 and the heating element 12 making contact with the heating element 12. It is noted that, alternatively, the indentations can also be provided before inserting the heating element 12 into the tube 11. For the indentation to become permanent, the tube is made of a material that is plastically deformable such as metal. In a final step 302, the heating element 12 and the tube 11 are imperviously connected on both ends of the water heating assembly 10. Optionally, also here a desired shape can be created by bending the entire water heating assembly 10. Finally, a water inlet 26 and water outlet 25, as represented in FIG. 1, are connected, such as by welding, in the tube at the appropriate locations. A temperature sensor can be connected in the water outlet such as in the mode of FIG. 9. Alternatively, the temperature sensor is connected, such as by welding, to the tube itself as in the mode of FIG. 10.

The presently disclosed and/or claimed inventive concept(s) is not limited to the examples and especially not to water heating assemblies for beverage machines. The characteristics of the exemplary embodiments can be used in any advantageous combination as long as being covered by the appended claims. It is noted that the term "water" used in the presently disclosed and/or claimed inventive concept(s) should be understood to cover any kind of liquid, such as (but not limited to) a liquid suitable for making beverages like coffee or tea. Furthermore, the presently disclosed and/or claimed inventive concept(s) is not limited to a particular number or dimension or type of the spacer element as long as the spacer element allows a corresponding affect on the flowing liquid like the generation of turbulences to increase the flow path or at least the exposure time of the water to the heat emitted by the heating element. The spacer elements described herein can also be combined and the can be separate and/or integral features of the tube and/or heating element. The overall geometry of the water heating assembly can be straight or, in certain non-limiting embodiments, curved as desired, such as (but not limited to) 2D- or 3D-helical to save space. In certain non-limiting embodiments, the gap provides a curved, and in particular (but non-limiting) embodiments, a helical flow path or part of the flow path surrounded by the tube.

The invention claimed is:

1. A water heating assembly, comprising:

an outer tube;

a core heating element, wherein the core heating element is arranged within the outer tube forming a gap between the core heating element and an inner wall of the outer tube, and wherein the core heating element is adapted to heat water within the gap;

a spacer element arranged within the gap between the core heating element and the inner wall of the outer tube;

a pump adapted to pump water through the gap between the core heating element and the inner wall of the outer tube;

at least one temperature sensor adapted to monitor at least a temperature at a water discharge end of the outer tube, wherein the at least one temperature sensor is arranged within the outer tube and in contact with the core heating element at the water discharge end of the outer tube, and wherein the at least one temperature sensor is adapted to:

sense a temperature of surrounding water if the gap is filled with water; and sense a temperature of the core heating element if the gap is not filled with water; and a control unit configured to control the temperature of the water, the control unit connected to each of the core heating element, the pump, and the at least one temperature sensor to form a control loop, the control unit is configured to receive a temperature measured by the at least one temperature sensor and configured to control the heating of the core heating element based upon the temperature sensed by the at least one temperature sensor, and the control unit configured to control an amount of pumping of the pump based upon the temperature sensed by the at least one temperature sensor, the control unit is configured to:

activate the core heating element;

receive the temperature from the at least one temperature sensor; and deactivate the core heating element.

2. The water heating assembly according to claim 1, wherein the gap extends along the whole flow path surrounded by the outer tube and wherein the spacer element is adapted to hold the outer tube and the core heating element at a defined distance.

3. The water heating assembly according to claim 1, wherein the outer tube is formed in a non-rectilinear, three-dimensional shape.

4. The water heating assembly according to claim 1, wherein the spacer element is a discrete element which is independent from the core heating element and the outer tube.

5. The water heating assembly according to claim 1, wherein the spacer element comprises a coil spring arranged between and in contact with the core heating element and the inner wall of the outer tube, and wherein the windings of the coil spring form a helical water flow path.

6. The water heating assembly according to claim 1, wherein the spacer element comprises at least one helical groove along the inner wall of the outer tube and/or along an outer wall of the core heating element, and wherein the groove forms a helical water path.

7. The water heating assembly according to claim 1, wherein the spacer element is formed from a plurality of spaced apart permanent indentations of the outer tube protruding inwardly, wherein the indentations are adapted to generate non-linear tortuous water flow path within the gap and/or water flow turbulence within the gap.

8. The water heating assembly according to claim 1, wherein the outer tube comprises a water inlet adapted to receive water to be heated and a water outlet adapted to discharge heated water, and wherein the core heating element is adapted to heat the water passing the core heating element within the gap.

9. The water heating assembly according to claim 1, wherein the outer tube is a stainless steel tube, and wherein the outer tube is imperviously welded or soldered to the core heating element at a water loading end of the outer tube and at the water discharge end of the outer tube.

10. The water heating assembly according to claim 1, wherein the outer tube is a heat resistant elastomer tube, and wherein the outer tube is imperviously connected to the core heating element at a water loading end of the outer tube and at a water discharging end of the outer tube by clamps.

* * * * *